United States Patent [19]

Leasure

[11] 4,031,932

[45] June 28, 1977

[54] PLANING ATTACHMENT FOR JOINTERS

[76] Inventor: Edgar F. Leasure, 4959 E. Lagoon Road, West Farmington, Ohio 44491

[22] Filed: June 28, 1976

[21] Appl. No.: 700,143

[52] U.S. Cl. ..... 144/117 R; 144/129; 144/242 R

[51] Int. Cl.[2] ..... B27C 1/12

[58] Field of Search ..... 144/114 R, 117 R, 116 R, 144/128, 129, 242 R

[56] References Cited

UNITED STATES PATENTS

| | | | |
|---|---|---|---|
| 771,894 | 10/1904 | Brumbaugh | 144/114 R |
| 1,447,878 | 3/1923 | Littleford et al. | 144/114 R |
| 2,102,186 | 12/1937 | Nicholson et al. | 144/116 |
| 2,642,902 | 6/1953 | Carey | 144/129 X |
| 2,780,250 | 2/1957 | Leonard | 144/114 R X |

*Primary Examiner*—J. M. Meister
*Assistant Examiner*—W. D. Bray
*Attorney, Agent, or Firm*—Michael Williams

[57] ABSTRACT

My invention relates to an attachment that may be connected as a unit to the bed of a conventional jointer to easily convert the same for planing operations. The attachment comprises support members which are adapted to be secured to the stationary bed of the jointer, threaded posts rigidly carried by the support members, sprockets threaded on the posts, a chain interconnecting the sprockets, and a bed plate carried by said sprockets for vertical adjustment. All of the foregoing is interconnected so that the purchaser may connect the attachment as a unit to the jointer bed. A spring plate is connected to the movable bed of the jointer for cooperation with the unit.

10 Claims, 5 Drawing Figures

PLANING ATTACHMENT FOR JOINTERS

BACKGROUND AND SUMMARY

The present invention relates to a relatively simple attachment for easy mounting on the bed of a jointer to convert the same for planing uses. In small woodworking shops, and particulary home workshops, the need for both jointing and planing operations frequently exists, but such small shops cannot afford the luxury of separate jointers and planers. My invention solves the problem in low-cost manner by providing the attachment herein disclosed.

My invention overcomes the disadvantages of the prior art and comprises a pair of steel bars which are adapted to be bolted to the stationary bed of the jointer. Four screw rods are rigidly carried by the bars and extend upwardly therefrom, and a sprocket is threaded on each rod. Each sprocket has an undercut collar to closely receive a forked ear extending from a side of a bed plate, and an endless chain is trained over the sprockets. The foregoing forms a unit that may be adjusted at the factory and handled for transportation and installation. A flat steel spring is adapted to be attached to the movable bed of the jointer.

DESCRIPTION OF THE DRAWINGS

In the drawings accompanying this specification and forming a part of this application there is shown, for purposes of illustration, an embodiment which my invention may assume, and in these drawings.

DESCRIPTION OF THE PREFERRED EMBODIMENT

Figure 1:
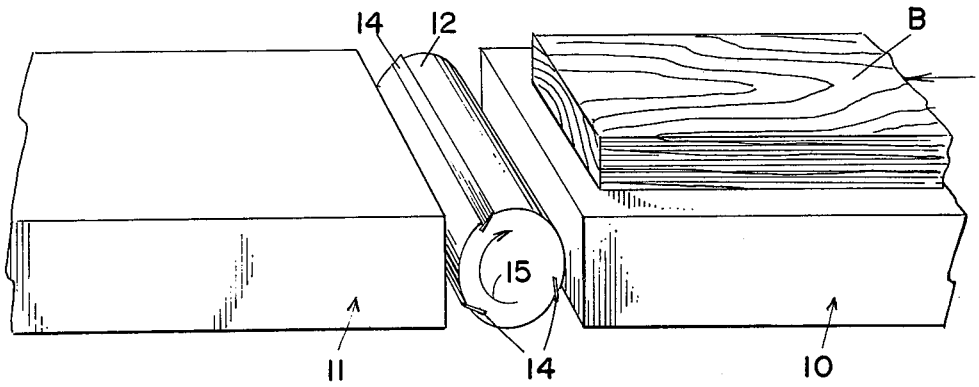
FIG. 1. PRIOR ART
FIG. 1 is a generally schematic view of the two beds of a jointer, and the cutter therebetween.

FIG. 1 shows the basic elements of a jointer, comprising a pair of beds 10 and 11, carried by a conventional supporting base (not shown). Normally, the bed 11 is fixed against vertical movement and the bed 10 is vertically adjustable in conventional manner. A rotary cutter 12 is disposed between adjoining ends of the beds and has longitudinally extending blades 14. The cutter is rotated in the direction of the arrow 15, and the blades 14 cut into the bottom surface of a board B when the latter is slid along the upper flat surface of the bed 10 in the direction of the arrow and over the cutter. This is a normal jointer operation to smooth the bottom surface of the board B.

Figure 2:
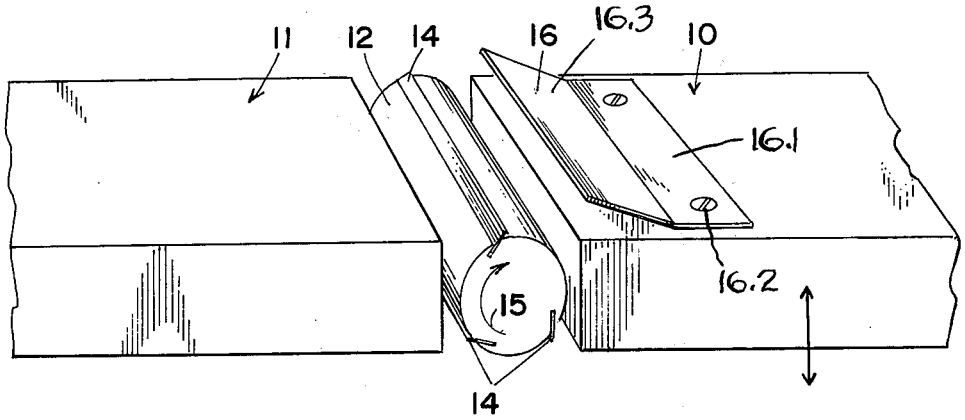
FIG. 2 is a view similar to FIG. 1, with a spring plate added, FIG. 3 adds a bed plate to the construction shown in FIG. 2, to illustrate a board being pushed against the bed plate for planing operations.

In FIG. 2, a spring plate 16 is attached to the upper surface of the bed 10. This spring may be formed of tempered sheet steel and includes a flat portion 16.1 having a pair of holes to pass flat head screws 16.2, the latter being threaded into holes which are drilled and tapped in the bed 10 at predetermined locations. The plate has an upwardly angled portion 16.3 which is adapted to push the board B upwardly and into engagement with the flat bottom surface of a bed plate 17.

Figures 4, 5:
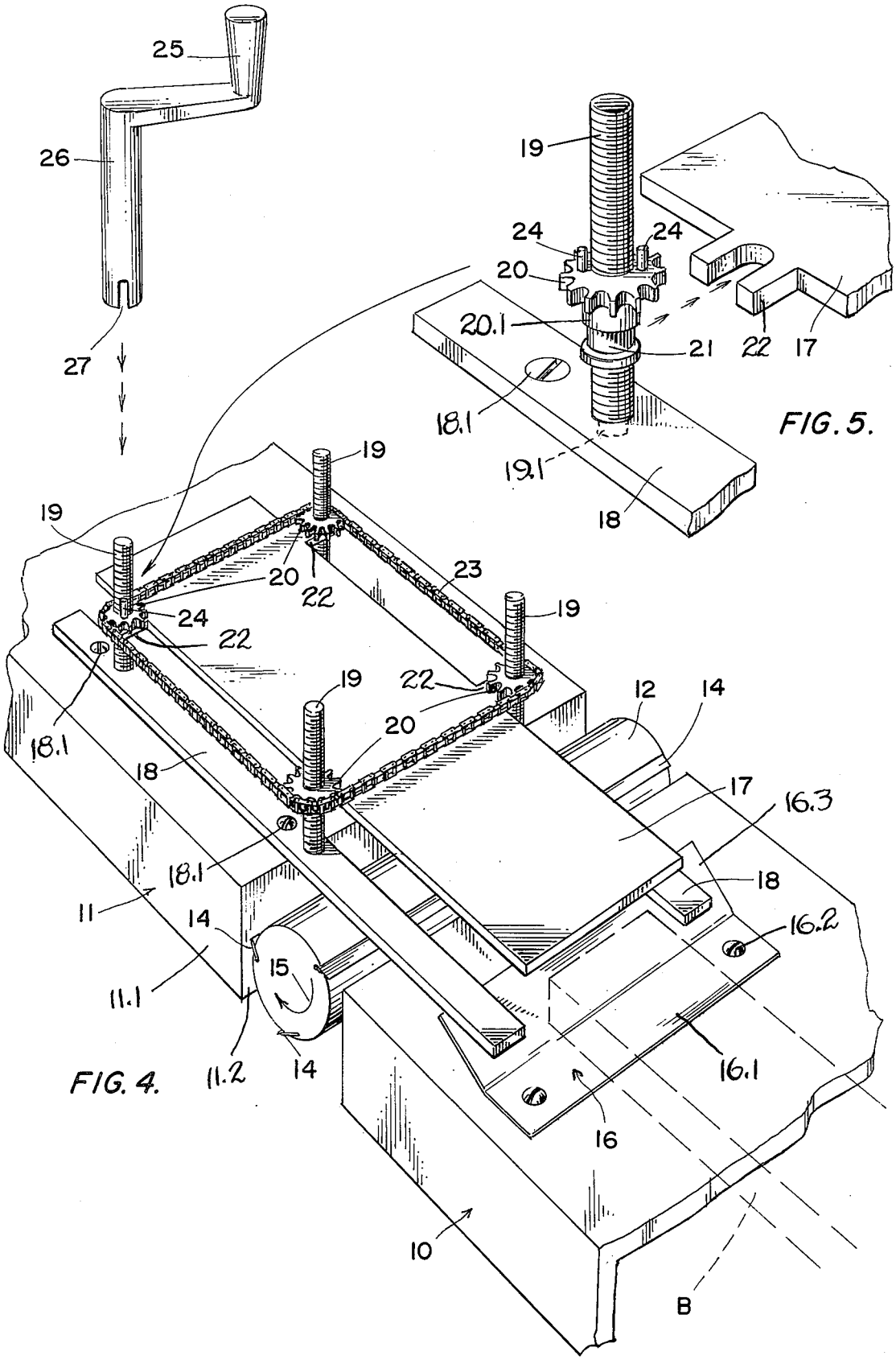
FIG. 4 is a fragmentary perspective view of an attachment illustrating a presently preferred embodiment of my invention.
FIG. 5 is an enlarged, separated perspective view of details.

As seen in FIG. 4, two steel bars 18,18 support the planar attachment from the bed 11. Each bar has a pair of holes to pass flat screws 18.1, the latter being threaded into holes which are drilled and tapped in the bed 11 at predetermined locations. In assembled position on the bed 11, the bars 18 are in spaced side-by-side relation and extend along the line of normal board movement over the bed 11. One or the other of the facing side edges of the bars may be used to guide the board longitudinally. The forward ends of the bars 18 and the forward end of the bed plate 17 overhang the rotary cutter 12 and the spring plate 16.

Two screw rods 19 are rigidly carried by each bar 18 and extend upwardly therefrom an equal distance, with their axes normal to the upper flat surface of the bed 11. The rods may be connected to the bars in any suitable manner to hold them against rotation. As shown in FIG. 5, the lower end of each rod 19 may be formed with a slightly reduced diameter 19.1 to form a shoulder which bears against the upper surface of the bar. The reduced diameter closely fits within a hole in the bar and may be welded therein to insure non-rotation of the screw rod.

A sprocket gear 20 has an internally screw-threaded hub 20.1 so that the sprocket may be threaded on a respective rod 19. Each hub 20.1 has an undercut 21 which closely receives a fork 22 integral with the bed plate 17 and extending from a side edge thereof. As before described, the screw rods 19 are rigidly secured to the respective bars 18 and each bar, with its rods, may be moved in a direction toward a side edge of the bed plate 17 to seat the forks 22 within the undercuts 21. The sprocket gears at this point are individually rotated for vertical adjustment. Thus, adjustment may be made at the factory with the bars 18 temporarily connected to a flat surface which simulates the upper flat surface of the bed 11. When the sprocket gears have been adjusted so that the lower flat surface of the bed plate is parallel to the simulated surface, an endless chain 23 is trained over all four sprocket gears and the chain is drawn taut enough to prevent removal of the forks 22 from the undercuts 21. Thus, the chain 23 not only causes all sprocket gears to rotate in the same direction the same amount, but also holds the parts connected so that the attachment may be handled as a unit.

One sprocket (the one shown in FIG. 5) has a pair of drive stubs 24 extending upwardly therefrom. A manually operable handle 25 is utilized to rotate the drive stub sprocket and the other three sprockets chained thereto. The handle has a tubular portion 26 which is adapted to be positioned over the screw rod 19 and has slots 27 in its lower end to fit the drive stubs 24.

With the attachment and the spring plate connected to respective jointer beds 10 and 11, the jointer has been converted for planing operations. The handle 25 is connected to the drive stubs 24 of the sprocket 20 and is rotated to move the bed plate 17 toward or away from the upper surface of the base 11 a predetermined amount dictated by the desired thickness of the board B to be planed.

Figure 3:
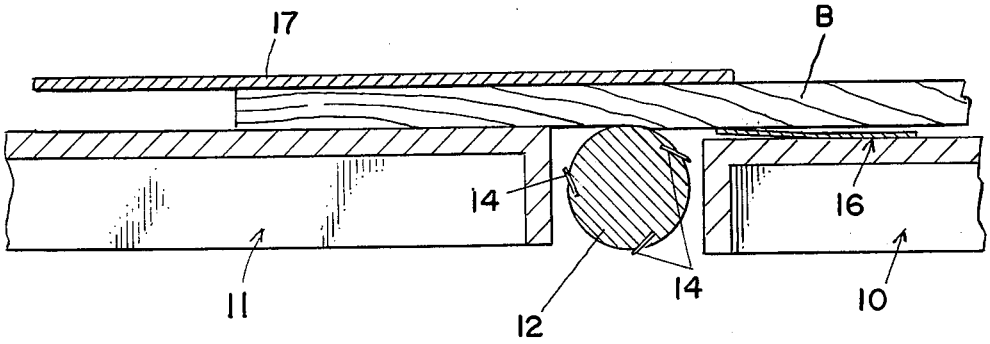

The board B is longitudinally aligned with the space between the bars 18 and is slid over the upper surface of the bed 10. As the board passes over the spring plate 16, it is pressed upwardly so that its upper surface engages and slides along the lower flat surface of the bed plate. The distance between the upper part of the rotary cutter 12 and the lower surface of the bed plate 17 determines the thickness of the board after planing operations. The bed 10 is adjusted so that its upper surface is below the upper part of the rotary cutter, as seen in FIG. 3, to accommodate the flat spring 16. Vertical adjustment of the bed 10 adjusts the force which the spring applies to the undersurface of the board to push the latter upwardly.

Since the attachment for the bed 11 is a unit, the sprockets 20 may be adjusted at the factory so that upon installation on the bed 11, the undersurface of the bed plate 17 is parallel to the upper surface of the bed 11.

The attachment will be manufactured for installation on the beds of jointers of known bed sizes. In order to quickly and accurately locate the attachment holes in the bed 11, a template (not shown) may have a flat portion to overlie the upper surface of the bed 11, and this flat portion may have small holes through which the point of a punch may be inserted. The holes in the flat portion will be in the exact position for the attachment holes to be drilled so the punch point may be driven into the upper surface of the bed to provide starter points for drilling operations. The template may have angular edge portions for close engagement with a side 11.1 and end 11.2 of the base to quickly locate the template. A similar template (not shown) may be used to locate the holes for the screws 16.2 of the flat spring. With the holes drilled and tapped in the beds 10 and 11, it is a matter of minutes to install or remove the attachment and flat spring.

The flat spring 16 also provides a safety feature in that when the planing operation is completed, the rotary cutter 12 may have a tendency to kick the board rearwardly. However, when the tail end of the board passes the spring 16, the latter will automatically elevate and provide a stop against which the end of board abuts in the event it is kicked back. Even during planing operation, the spring offers a safety feature in the event the operator releases the board, since the upper edge of the spring will dig into the board to prevent kick back.

I claim:

1. A board planing attachment for a jointer having a bed with a flat upper surface and a rotary cutter adjacent to one end of said bed, comprising:

a pair of flat bars connected flatwise to said upper surface to extend in spaced side-by-side relation along the normal line of board movement over said flat upper surface, a pair of screw rods carried by each bar to extend upwardly therefrom with their axes normal to said flat upper surface, said rods being held to said bars against rotation, four sprocket gears, each having an internally threaded hub threaded on a respective rod, a bed plate overlying said bed upper flat surface and having an end portion overlying said cutter, said bed plate having a lower flat surface and a slide connection with each sprocket hub, each slide connection being disposed at a respective one of four spaced peripheral portions of said bed plate with two on each side of the latter, so that as said sprockets are rotated said bed plate is moved vertically at each said connection, whereby the lower flat surface of said bed plate may be brought into parallelism with the upper flat surface of said bed by screw adjustment of respective sprockets, the lower flat surface of said bed plate providing a guide for the upper surface of a board slid along the upper flat surface of said bed to define a predetermined selectable distance between said lower flat surface and said cutter.

2. The construction according to claim 1 wherein the hub of each sprocket gear has an annular undercut groove, and said bed plate has four fork extensions at said spaced peripheral portions, each fork extension fitting with a respective groove to provide said slide connection of said bed plate and each sprocket hub, each said fork extension permitting rotation of the respective sprocket gear and transmitting vertical movement of such gear to said bed plate.

3. The construction according to claim 1 and further including an endless chain trained over all four sprocket gears to effect unitary rotation of the latter.

4. The construction according to claim 3 wherein one of said sprocket gears has upstanding drive stub means, and a manually operable handle having a tubular portion to fit over and receive the upper portion of that screw rod on which said one sprocket gear is threaded, said tubular portion having drive slot means in its terminal end for releasable engagement with said drive stub means.

5. The construction according to claim 1 wherein all parts of said attachment are interconnected so that said attachment may be connected to and removed from said bed as a unit.

6. The construction according to claim 2 and further including an endless chain trained over all four sprocket gears to effect unitary rotation of the latter, said chain preventing removal of said fork extensions from the annular undercut grooves of respective sprocket gear hubs.

7. The construction according to claim 1 and further including resilient means for pressing the board against the lower flat surface of said bed plate as the board is moved through said cutter.

8. The construction according to claim 1, wherein said jointer has a pair of beds arranged in end-to-end relation, each with upper flat surfaces, and with said rotary cutter disposed between such ends whereby a board slid over the flat surface of one bed has its lower surface engaged by said cutter, said planing attachment being connected to the upper surface of the other of said bed with common ends of said bars and an end of said bed plate overhanging said cutter and an adjoining portion of the upper surface of said one bed, and a spring connected to said adjoining portion and operable to urge said board upwardly into engagement with the lower flat surface of said bed plate.

9. The construction according to claim 1 wherein said spring is formed of sheet spring metal, having a part connected to said adjoining portion and an angularly disposed part extending upwardly from the upper surface of said one bed.

10. The construction according to claim 9 wherein said one bed is vertically adjustable to thereby adjust the vertical position of said angularly disposed part of said spring.

* * * * *